US011738942B2

(12) United States Patent
Fitzgerald et al.

(10) Patent No.: US 11,738,942 B2
(45) Date of Patent: Aug. 29, 2023

(54) TRASH RECEPTACLE AND LID ASSEMBLY

(71) Applicant: Valet Living, LLC, Tampa, FL (US)

(72) Inventors: Thomas M. Fitzgerald, Naples, FL (US); David McClanahan, Harleysville, PA (US)

( * ) Notice: Subject to any disclaimer, the term of this patent is extended or adjusted under 35 U.S.C. 154(b) by 0 days.

(21) Appl. No.: 17/000,964

(22) Filed: Aug. 24, 2020

(65) Prior Publication Data

US 2021/0061559 A1 Mar. 4, 2021

Related U.S. Application Data

(60) Provisional application No. 62/894,720, filed on Aug. 31, 2019.

(51) Int. Cl.

| | |
|---|---|
| ***B65F 1/16*** | (2006.01) |
| ***B65F 1/02*** | (2006.01) |
| ***B65F 1/14*** | (2006.01) |

(52) U.S. Cl.

CPC ..... *B65F 1/1646* (2013.01); *B65F 1/02* (2013.01); *B65F 1/1623* (2013.01); *B65F 2001/1494* (2013.01); *B65F 2001/1653* (2013.01)

(58) Field of Classification Search

CPC ..... B65F 2001/1669; B65F 2001/1494; B65F 1/1646; B65D 47/0866

USPC ..... 220/908–911, 88.1

See application file for complete search history.

(56) References Cited

U.S. PATENT DOCUMENTS

| | | | | |
|---|---|---|---|---|
| 1,237,016 | A | 8/1917 | Brown | |
| 2,246,975 | A | 6/1941 | Geibel | |
| 2,732,972 | A * | 1/1956 | Anschicks | B65D 43/24 220/88.1 |
| 5,323,923 | A | 1/1994 | Schauer | |
| 5,593,619 | A * | 1/1997 | Bottelberghe | C09K 21/08 570/186 |
| 5,960,983 | A | 10/1999 | Chan | |
| 7,070,003 | B1 | 7/2006 | Smith | |
| 10,450,135 | B2 | 10/2019 | Gensicke et al. | |
| 2005/0242093 | A1* | 11/2005 | Sharpe | F42B 39/14 220/62.11 |
| 2008/0105680 | A1* | 5/2008 | Carter | B65F 1/163 220/264 |
| 2016/0052711 | A1* | 2/2016 | Fitzgerald | B65F 1/06 220/495.08 |

FOREIGN PATENT DOCUMENTS

| | | | | |
|---|---|---|---|---|
| WO | WO-8202701 A1 * | 8/1982 | | B65F 1/16 |
| WO | WO-2012104441 A1 * | 8/2012 | | B65F 1/085 |

* cited by examiner

*Primary Examiner* — Mollie Impink
(74) *Attorney, Agent, or Firm* — Thomas H. Stanton

(57) ABSTRACT

The invention in one form is directed to a trash receptacle and lid assembly configured to aid in the prevention of fires having a rim-stop on the lid, that prevents the lid from being opened beyond the point where the lid center of gravity is located in the open position to ensure that the lid stays closed.

11 Claims, 12 Drawing Sheets

TRASH RECEPTACLE AND LID ASSEMBLY

CROSS-REFERENCE TO RELATED APPLICATION

This application claims priority from U.S. Provisional Patent Application No. 62/894,720, filed Aug. 31, 2019, titled TRASH RECEPTACLE AND LID ASSEMBLY which is hereby incorporated by reference herein for all purposes.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

Trademarks used in the disclosure of the invention and the applicants make no claim to any trademarks referenced.

BACKGROUND OF THE INVENTION

1) Field of the Invention

The invention relates to trash receptacle and lid assembly configured to aid in the prevention of fires, and, more particularly to a trash receptacle having a lid which is self-closing.

2) Description of Related Art

Each year fire claims the lives of 3,500 Americans, injures 18,300, and causes billions of dollars of damage. Leading causes of home and apartment fires are heating, electrical, smoking materials and trash receptacles. Trash receptacles, due to their compact size, variety of their contents, including combustibles, fire initiators and the ready availability of fuel, are an ideal environment for the initiation of fires. However, when the trash receptacle lid is closed, oxygen availability for the fire is reduced, and this can prevent the fire from forming or growing, to the point that the receptacle is compromised.

The problem associated with trash receptacle fires have been exacerbated with the advent of storing and collecting trash in containers within a structure such as garages, trash collection areas in apartment complexes, and individual apartment trash receptacles used by individual collection services.

One way to mitigate the fire hazard, is to provide all trash receptacles with lids which theoretically limit the oxygen available for combustion, and thereby limit the fire hazard. However, removable lids can be removed and not reinstalled by the user after placing trash in the trash receptacle and that defeats the protection afforded by a lid. To address this situation, trash receptacles with attached lids have been deployed to replace trash receptacles with removable lids. The opening and closing of these attached lids is manual and still requires that the user close the lid to ensure that the lid is closed and to provide the protection afforded by a lid. Furthermore, given that there is no restriction in the rotation of the attached lids, in many cases, the lids may not be closed by users, which defeats the fire protection capability of the lid.

Additionally, since most trash receptacles are formed from plastic and composite resins, it therefore eliminates the issues of rusting and denting damage which are problems with metal trash receptacles. Plastic and composite resins present additional problems because the resins can also provide fuel for a fire that starts in the contents of a trash receptacle cavity.

Therefore, what is needed in the art is a trash receptacle with a lid that provides a passive means for insuring that the lid is closed, to minimize the problems associated with trash receptacle fires.

Additionally, there needs to be a formulation for fire-retardant plastic to fabricate a trash receptacle to prevent the plastic from melting and/or burning and allowing the fire to spread.

BRIEF SUMMARY OF THE INVENTION

The invention in one form is directed to a trash receptacle and lid assembly configured to aid in the prevention of fires having a rim-stop on the lid that prevents the lid from being opened beyond the point where the lid's center of gravity is located in the open position, to ensure that the lid stays closed. The fire is the result of combustion of material stored in the trash receptacle.

The invention in another form, is directed to a lid and/or trash receptacle as made from a fire-retardant plastic, to prevent the plastic from melting and/or burning, and providing fuel for a fire which is initiated from the trash receptacle. The fire-retardant plastic may be configured to not sustain a flame.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

Corresponding reference characters indicate corresponding parts throughout the several views. The exemplifications set out herein, illustrate embodiments of the invention, and such exemplifications are not to be construed as limiting the scope of the invention in any manner.

DETAILED DESCRIPTION

Figure 1:
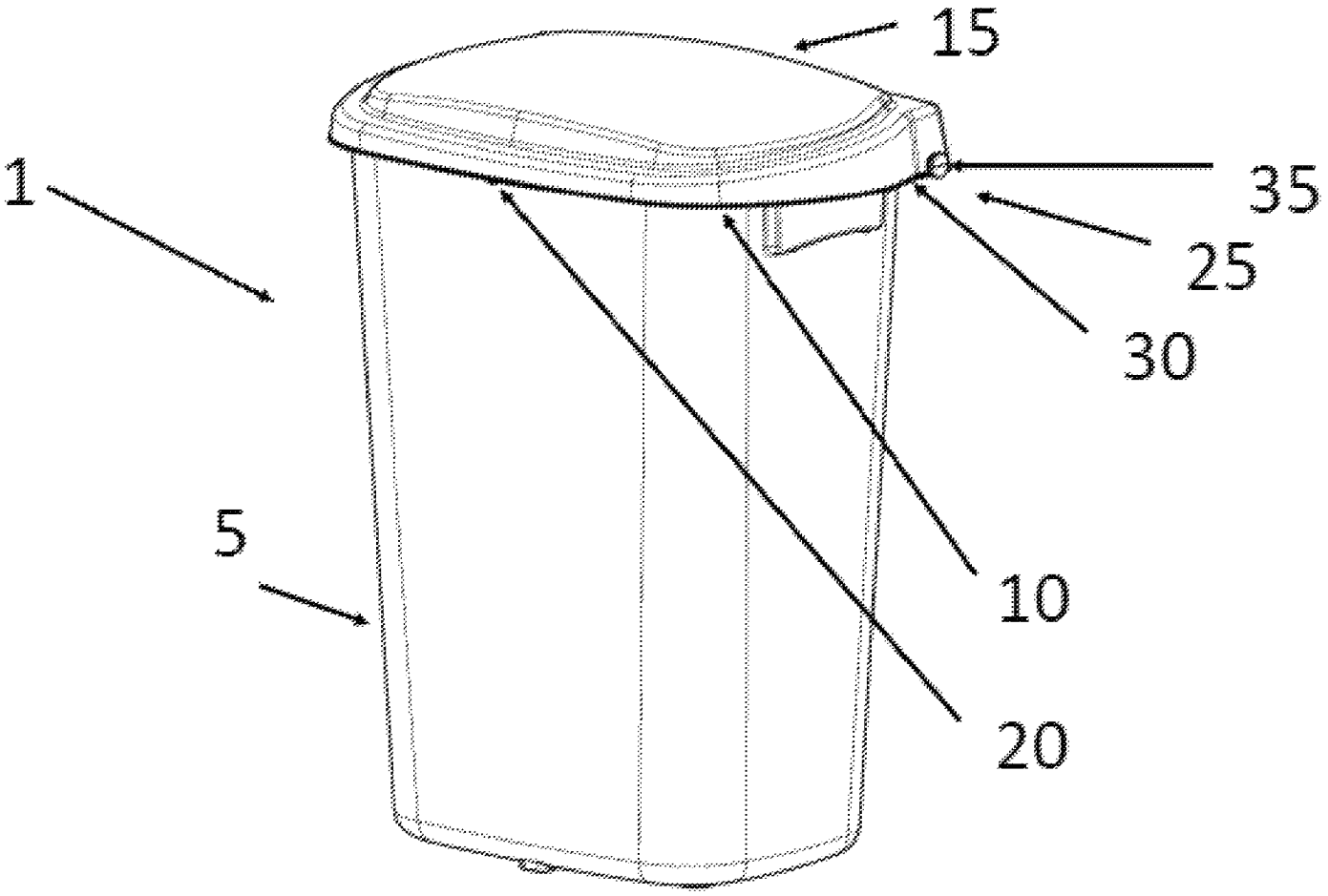
FIG. 1 shows a perspective view of a trash receptacle and lid assembly of the trash receptacle of the instant invention with the lid in a closed position.

In the following description, numerous specific details are set forth. However, it is understood that embodiments of the invention may be practiced without these specific details. In other instances, well-known structures and techniques have not been shown in detail in order not to obscure the understanding of this description. Those of ordinary skill in the art, with the included descriptions, will be able to implement appropriate functionality without undue experimentation.

References in the specification to "one embodiment" or "an embodiment," may indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that such feature, structure, or characteristic may be deployed in connection with other embodiments whether or not explicitly described.

Lastly, the terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

As this invention is susceptible to embodiments of many different forms, it is intended that the present disclosure be considered as an example of the principles of the invention and not intended to limit the invention to the specific embodiments shown and described.

The terms people, user, consumer and individual are used interchangeably to mean an individual who uses the invention.

The terms lid skirt and skirt are used interchangeably to mean the skirt of the lid.

The term solid, as used in the disclosure, refers to a solid surface with no holes except for holes required to fasten parts to, and for providing the hinge properties for the lid and can.

The term trash receptacle, trash container, trash can, receptacle are used interchangeably to mean a trash receptacle of the invention.

The term trash receptacle lid, trash can cover, trash can top are used interchangeably to mean a trash receptacle lid of the invention.

The term can, as used in this disclosure, refers to the bottom portion of the trash receptacle of the invention which is comprised of at least 2 sides, front, back and bottom which form a hollow cavity of the can.

The term hinge and trunnion are used interchangeably in the disclosure, and refer to a movable joint or mechanism on which a door, gate, or lid, swings as it opens and closes, or which connects linked objects.

The term trunnion as used in the disclosure refers to a two-part mechanism comprising of a rotating joint, where a shaft or pin is inserted into and turns inside a hole adapted to receive the shaft or pin.

As used in the invention, the term plastic and resin are used interchangeably to mean the plastic material used to make the trash receptacle and trash receptacle lid of the invention.

The prior art does not provide for a trash receptacle the has a passive means for insuring that the lid is closed to minimize the problems associated with trash receptacle fires. The prior art includes U.S. Pat. No. 10,450,135 issued Oct. 22, 2019; U.S. Pat. No. 7,070,003 issued Jul. 4, 2006; U.S. Pat. No. 5,960,983 issued Oct. 5, 1999; U.S. Pat. No. 5,323,923 issued Jan. 28, 1994; U.S. Pat. No. 2,246,975 issued Jun. 24, 1941; and U.S. Pat. No. 1,237,016 issued Aug. 14, 1917, the contents of which are incorporated by reference in their entirety.

The trash receptacle and lid assembly comprises of a trash receptacle or can, a lid and a hinge or trunnion that connects the top of the trash receptacle to the lid such that the lid is rotatably attached to the top of the trash receptacle. The trash receptacle and lid assembly of the instant invention is configured to aid in the prevention of fires by providing a method to passively close the lid after every opening. The concept of passive closing is an important one, in that it does not require the user to close the lid, but that when the user opens the lid to deposit trash into the trash receptacle, and the user releases the lid, it is rotated around the axis of the hinge returning the lid to the closed position. This is accomplished by the incorporation of a rim-stop on the lid, that prevents the lid from being opened more than an opening angle where the center of gravity is positioned; the lid will therefore return to the horizontal closed position when it is released. Theoretically, a maximum angle of 85 degrees will ensure that the lid returns to the closed position after being open, however, any angle where the lids' center of gravity, is outside of the center of the hinge axis, can be used. The preferred embodiment of the rim-stop of the invention, extends from the back side of the lid, and engages or hits the back surface of the receptacle container forming the can of the trash receptacle, when the lid is rotated into the open position. This prevents the lid center of gravity from being opened further then the center of the hinge axis, which provides the gravitational force to return the lid to the closed position. When the lid is released, the force of gravity acting on the lid will rotate the lid, returning it to the closed position without the user having to close the lid. The opening angle or open angle of the lid, with respect to a horizontal axis can be from 89 degrees to 50 degrees, to allow the user adequate clearance to deposit the trash in the opening of the trash receptacle caused by the rotation of the lid away from the front of the trash receptacle. The rim-stop of the instant invention may be an extension located on the rim of the lid that extends down below the rim and results in an interference between the lid and the back of the trash receptacle can. The rim-stop can be either one or more extensions, and can be either an integrally molded part of the lid or they can be attached to the lid with the appropriate fasteners such as adhesive, screws or bolts. The preferred embodiment of the rim-stop may be extended down furthest to create the interference with the back side of the trash receptacle or receptacle. A preferred rim-stop of the instant invention may have a curved surface to provide a gradual engagement with the surface of the receptacle that may flex upon engagement with the rim-stop, creating the interference with the back side of the trash receptacle or receptacle.

The lid of the trash can or receptacle of the invention, is coupled to a trash receptacle or receptacle by a hinge. The lid and the trash receptacle each have a component of the hinge which makes the lid rotatable about the back of the trash receptacle when the user lifts the front of the lid of the trash receptacle rotating the lid about the hinge and creating an opening to allow the user to deposit trash into the can. A preferred hinge of the invention comprises a post and an aperture or slot that extends over or partially around the post. Specifically, a post may extend from opposing sides of the trash receptacle or receptacle, and the lid may have slots on either side that are configured to extend around the post on the trash receptacle or receptacle. Note that the post may alternatively be reversed, and extend from the lid and into apertures or slots in the receptacle.

The trash receptacle or receptacle of the instant invention may have a rim that extends down over the top perimeter of the receptacle to enclose the top opening. This may further prevent air entry into the receptacle when the lid is closed, which reduces the available oxygen for any combustion inside of the trash receptacle or receptacle.

The lid and/or trash receptacle or receptacle of the instant invention is preferably made from a fire-retardant plastic, to prevent the plastic from melting and/or burning and allowing the fire to spread. The fire-retardant plastic may be configured so as to not sustain a flame. The most common flame-retardant plastic additives are brominated flame retardants (BRFs). Brominated flame retardants are organohalogen compounds. The lid or receptacle may meet a UL94 rating of 5VA, 5VB, V-0, V-1, V-2 or HB, as detailed in Table 1 below. The highest rating is V-0 which is the preferred rating.

TABLE 1

| UL 94 Rating | Definition of Rating |
|---|---|
| HB | Slow burning on a horizontal part |
| V-2 | Burning stops within 30 seconds on a part allowing for drops of vertical flammable plastic. |
| V-1 | Burning stops within 30 seconds on a vertical part allowing for drops of plastic that are not inflames. |
| V-0 | Burning stops within 10 seconds on a vertical part allowing for drops of plastic that are not inflames. |
| 5VB | Burning stops within 60 seconds on a vertical part allowing for drops of plastic that are not inflames. |
| 5VA | Burning stops within 60 seconds on a vertical part allowing for drops of plastic that are not inflame |

UL 94 is a plastics flammability standard released by the Underwriters Laboratories (USA). The standard classifies plastics according to how they burn in various orientations and part thicknesses, from the lowest flame-retardant to most flame-retardant in six different classifications As detailed in: https://www.craftechind.com/this-plastics-on-fire-4-types-of-flame-retardant-plastic-additives/, most plastics are flammable. Therefore, it is often necessary to add flame retardant plastic additives to meet governmental and industry regulatory standards. Flame retardant plastic additives are compounds added to plastics and other materials to inhibit, suppress, or delay combustion. These compounds are useful in impending burning in the ignition phase of fire. They do not prevent charring or melting, nor do they increase the heat resistance of a material. Flame retardants are also not effective when a fire is fully engaged. There is no universal additive for all plastics, rather each flame retardant is specific to a particular polymer and a particular flammability test.

To understand how flame retardants work, it is necessary to understand how materials burn. When we see the flame of a burning object, we are actually seeing the combustion of flammable gases given off during its thermal decomposition. This process is call pyrolysis.

Pyrolysis is the process in which the long-chain molecules of a polymer chain degrade into smaller hydrocarbon molecules and flammable gases. These gases mix with oxygen, and exothermic chemical reactions occur, producing free radicals (H and OH). In complete combustion, H2O and CO2 are produced, as well as other material specific gases. The way that flame retardants interfere in the pyrolysis of a polymer, depends on the flame retardant(s) used and the plastic burned. Flame retardants can be either active or reactive. Active means blended into a polymer and reactive means inserted in the polymer molecule. Both types can suppress ignition in the vapor (gaseous) state of a fire and in the condensed (solid) state. Three common processes include endothermic degradation, gas phase radical quenching, and thermal shielding.

1) Endothermic Degradation

Mineral compounds such as aluminum and magnesium hydroxides are well known as antacids, but they can also be used as flame retardants. These plastic additives break down endothermically when subjected to high heat. This process removes heat from the plastic and cools the material. While high processing temperatures for plastics and relatively low decomposition temperatures for hydroxides and hydrates can limit their use, aluminum hydroxide did account for over 70% of total market demand in 2012. Mineral flame retardants are usually additive, and include boron compounds, antimony oxides, huntite, hydromagnesite, and zinc oxides.

2) Gas Phase Radical Quenching

The most common flame-retardant plastic additives are brominated flame retardants (BRFs). Brominated flame retardants are organohalogen compounds. Chlorinated and brominated compounds undergo thermal degradation releasing hydrogen chloride and hydrogen bromide. These react with H and OH radicals in the flame producing chlorine and bromine radicals. As the halogen radicals are less reactive than H or OH radicals, they retard the oxidation reactions of the flame. Halogenated flame retardants are low in cost and work on a wide variety of polymers. It should be noted that halogenated retardants are considered toxic to humans and animals and many have been banned.

3) Thermal Shielding

Phosphorus flame retardants, which include phosphate-ester compounds, are non-halogenated compounds that act on the solid state of combustible materials. Phosphorus forms phosphoric acid when heated which chars the solid, forming a thick glassy layer of carbon. This charring prohibits pyrolysis, and thus less fuel is available for the fire. Phosphorous flame-retardant plastic additives can be additive or reactive. Additionally, one can purchase halogenated organic phosphorus compounds that include a halogen and phosphorus. The halogen acts on the gas phase of a fire and the phosphorus inhibits fire in the sold state.

4) Synergists

Most flame-retardant plastic additives are combined to improve their overall efficacy. For example, brominated compounds are often used in synergy with antimony trioxide. This combination acts as a catalyst to speed the release of bromine and chlorine radicals in gas phase radical quenching.

The design of the can is important to the fire containment and extinguishing properties of the trash receptacle or receptacle of the instant invention. The lid must adequately seal the trash receptacle or receptacle, and the trash receptacle or receptacle can, cannot have any openings along the bottom, or the sides to allow entry of air that would support a combustion.

Referring now to the drawings FIGS. 1-12, and more particularly to FIG. 1, there is shown a perspective view of a trash receptacle and lid assembly of the trash receptacle of the instant invention with the lid in a closed position. The trash receptacle 1 is comprised of can 5 having rim 10, a lid 15 with latch 20 and 2 sides, front, back and bottom which forms a hollow cavity of the can 5. The 2 sides, front, back and bottom form an inner cavity of the can. The Lid 15 is rotatably mounted to can 5 by first trunnion 25 comprising of padeye 30 which is part of lid 15 and pin 35 which is part of trash receptacle 5 and second trunnion 26 comprising of padeye 31 which is part of lid 15 and pin 36 which is part of trash receptacle 5. Wherein the first trunnion is associated with the first side and the second trunnion is associated with the second side. However, in alternative embodiments, the padeye 30 can alternatively be on the can 5, and the pin 35 can be on the lid 15. The trash receptacle 5 having a solid bottom and solid 2 sides, front and back and a lid 15 formed with a solid top and four lid skirts perpendicular to the solid top and capable of fitting over the rim 10 and the lid skirt forming the front side, backside and 2 sides of the lid. The trash receptacle 5 having a solid bottom and at least solid four sides, bottom and a lid 15 being made from a fire-retardant plastic or thermoplastic material such as polyethylene with various additives to improve the fire retarding properties of the polyethylene. The trash receptacle 5 having 2 sides, front, back, bottom and lid 15, are constructed such that there are no holes to allow air to freely enter the trash receptacle 5 when the lid 15 is closed and the 2 sides, lid 15, front, back and bottom having a first side and a back side opposite the first side and the first side is arranged to face the cavity of the can.

Figure 2:
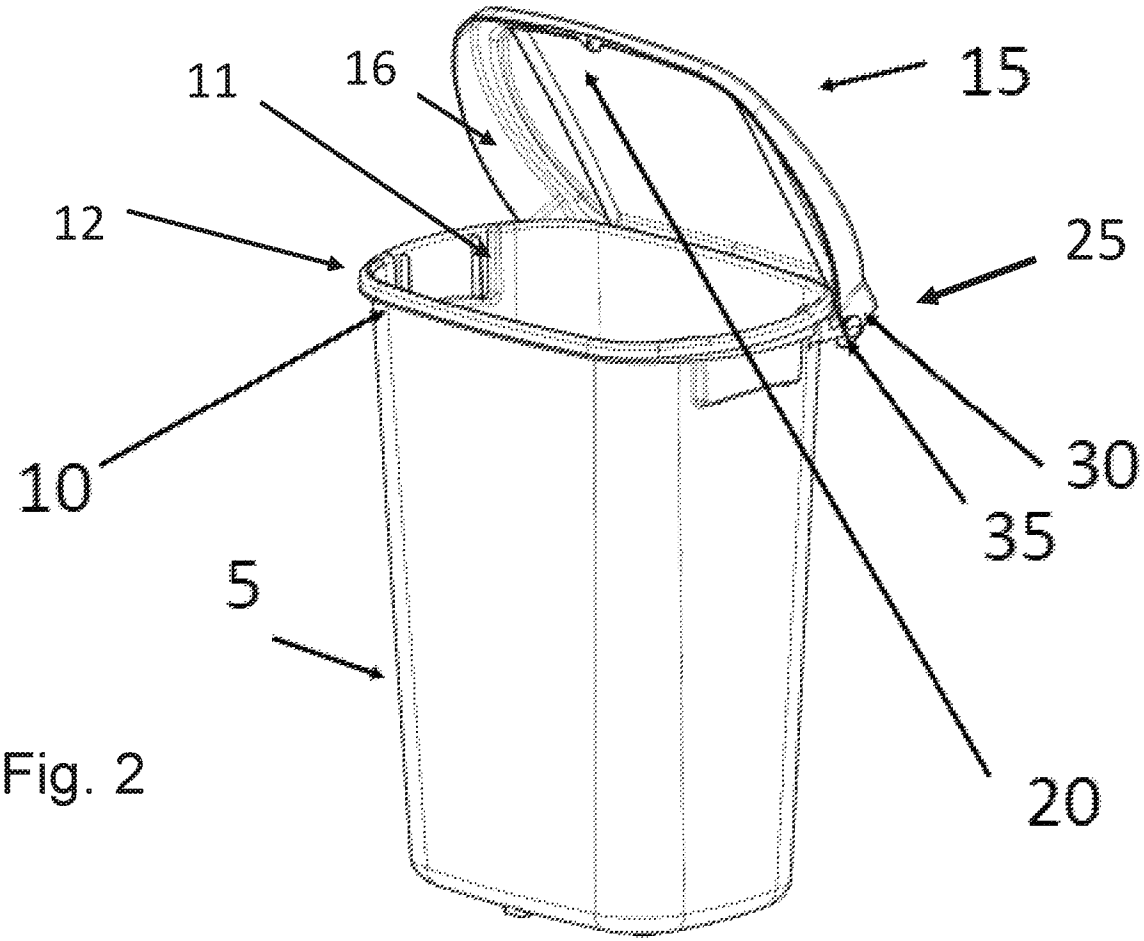
FIG. 2 shows a perspective view of a trash receptacle and lid assembly of the trash receptacle of the instant invention with the lid in an open position.

FIG. 2 shows a perspective view of a trash receptacle and lid assembly of the trash receptacle of the instant invention with the lid in an open position. The trash receptacle 1 is comprised of trash receptacle 5 having rim 10 forming a perimeter 12 which surrounds the opening 11 in the top trash receptacle 5 and a lid 15 with latch 20 on skirt 16 which fits over the rim 10 when the lid is closed. Lid 15 has a skirt 16 that extends over the rim 10 when the lid is closed, and lid 10 is rotatably mounted to trash receptacle 5 by trunnion 25 comprising of padeye 30 which is part of lid 15 and pin 35 which is part of trash receptacle 5. The lid 15 has a latch 20 which is engageable to rim 10 of trash receptacle 5 such that the rim 10 is formed around the perimeter of the opening of the trash receptacle 5.

Figure 3:
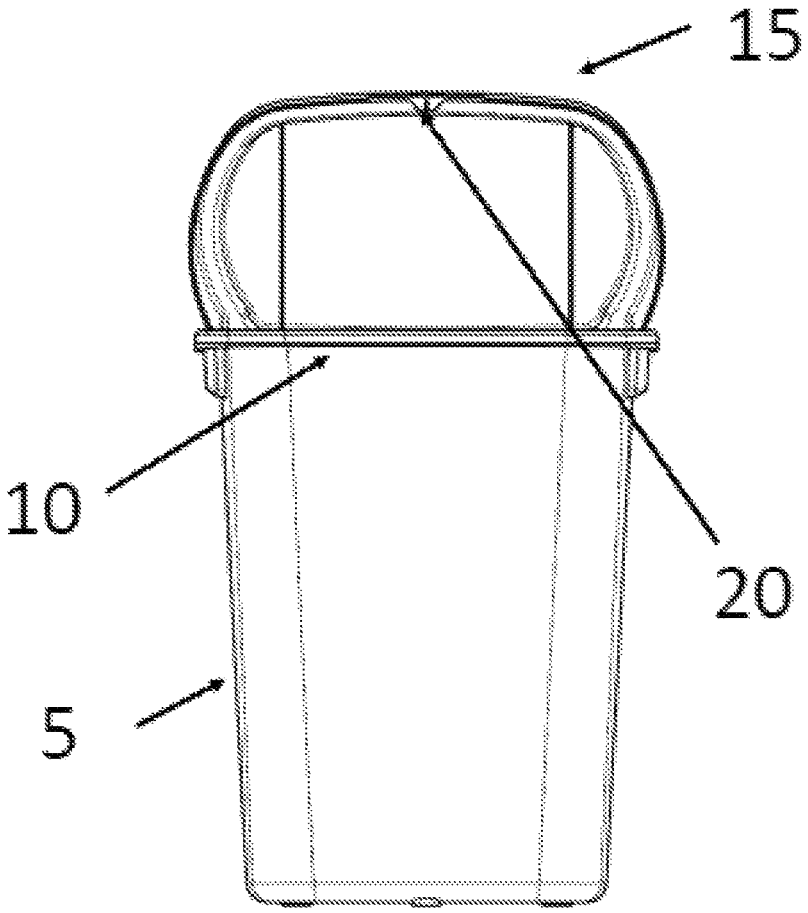
FIG. 3 shows a front view of a trash receptacle and lid assembly of the trash receptacle of the instant invention with the lid in an open position.

FIG. 3 shows a front view of a trash receptacle and lid assembly of the trash receptacle of instant invention with the lid in an open position. Latch 20 is shown located on the underside and on the proximal edge of lid 15 and located approximately halfway between the left and right sides of lid 15.

Figure 4:
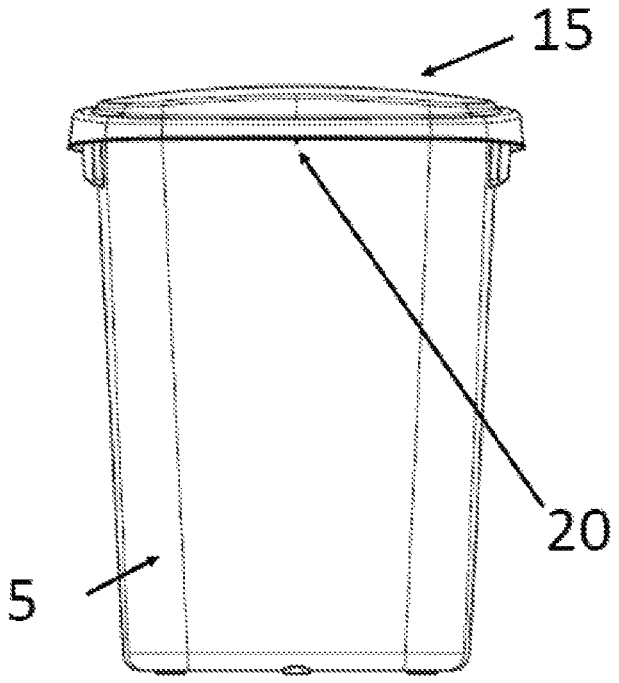
FIG. 4 shows a front view of the trash receptacle and lid assembly of the instant invention with the lid in a closed position.

FIG. 4 shows a front view of the trash receptacle of the instant invention and lid assembly with the lid in a closed position. Latch 20 is shown located on the underside and on the proximal edge of lid 15.

Figure 5:
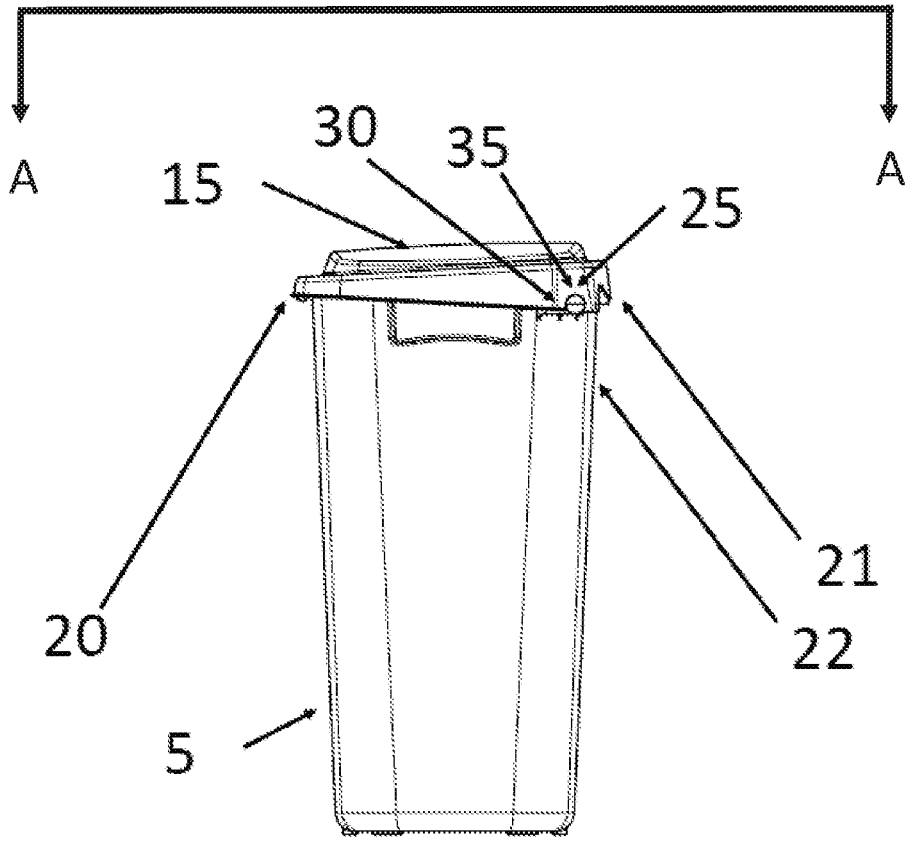
FIG. 5 shows a side view of the trash receptacle and lid assembly of the instant invention with the lid in a closed position.

FIG. 5 shows a side view of the trash receptacle of the instant invention and lid assembly with the lid in a closed position. Latch 20 is shown located on the underside and on the proximal edge of lid 15 and the rim-stop 21 is shown on the back of lid 15. The preferred configuration of rim-stop 21 is a single rim-stop 21 with a curved extended edge where the most distal part of the curve is located at the center of the rim-stop 21, which is located on the center of the edge of the lid 15 that is proximal to the padeyes 30. However, larger trash receptacles 5 may utilize one or more rim-stops 21 which can have either a curved or rectangular shape. Additionally, Lid 15 is rotatably mounted to trash receptacle 5 by trunnion 25 comprising of padeye 30 which is part of lid 15, and pin 35 which is part of trash receptacle 5. The rim-stop 21 in the closed position is disengaged from the back 22 of trash receptacle 5.

Figure 6:
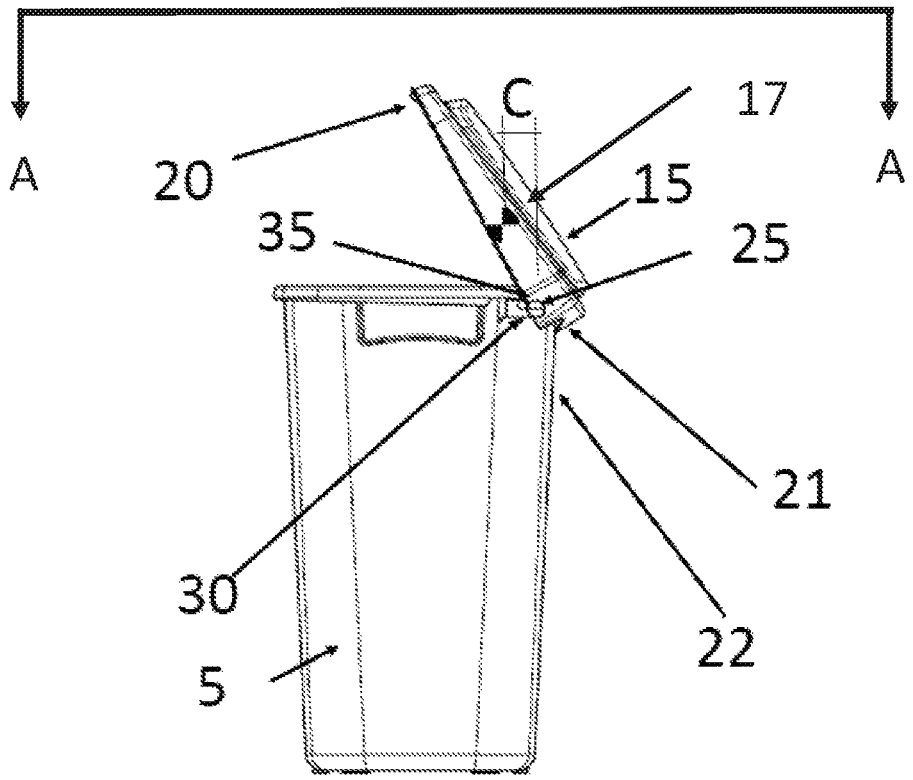
FIG. 6 shows a side view of the trash receptacle and lid assembly of the instant invention with the lid in an open position.

FIG. 6 shows a side view of the trash receptacle of the instant invention and lid assembly, with the lid in an open position. Latch 20 is shown located on the underside and on the proximal edge of lid 15 and the rim-stop 21 is shown on the back of lid 15. Lid 15 is rotatably mounted to trash receptacle 5 by trunnion 25 comprising of padeye 30 which is part of lid 15, and pin 35 which is part of trash receptacle 5. The rim-stop 21 in the open position is engaged with the back 22 of trash receptacle 5. The rim-stop 21 stops the lid 15 from rotating around trunnion 25, so that the center of gravity 17 of the lid 15 is located over opening 11, a distance C from the trunnion 25 and the force of gravity will rotate the opening 11 to close the lid 15 when the user removes their hand, used to open the lid 15. The distance C, is preferably 0.15 as long as the width E, shown in FIG. 10 of the trash receptacle opening 11. However, different ratios can also result in the lid being self-closing. The key is to provide a lid 15 which has an opening angle D shown in FIG. 10 of a minimum of 50 degrees to a maximum of 89 degrees.

Figure 7:
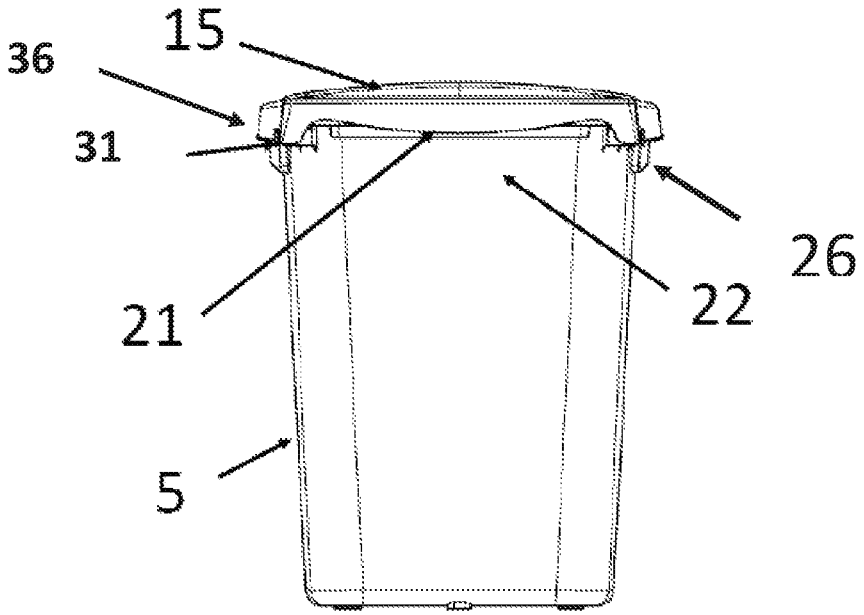
FIG. 7 shows a rear view of the trash receptacle and lid assembly of the instant invention with the lid in a closed position.

FIG. 7 shows a rear view of the trash receptacle of the instant invention and lid assembly with the lid in a closed position. The rim-stop 21 is shown on the back of lid 15. Lid 15 is rotatably mounted to trash receptacle 5 by trunnion 25. The rim-stop 21 in the closed position is disengaged from the back 22 of trash receptacle 5.

Figure 8:
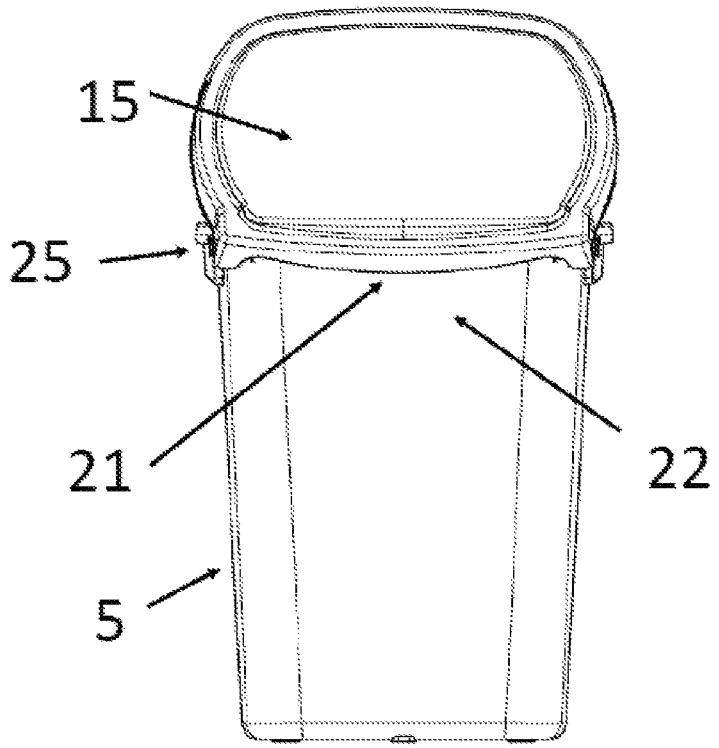
FIG. 8 shows a rear view of the trash receptacle and lid assembly of the instant invention with the lid in an open position.

FIG. 8 shows a rear view of the trash receptacle of the instant invention and lid assembly with the lid in an open position. The rim-stop 21 is shown on the back of lid 15. Lid 15 is rotatably mounted to trash receptacle 5 by trunnion 25. The rim-stop 21 in the open position is engaged with the back 22 of trash receptacle 5.

Figure 9:
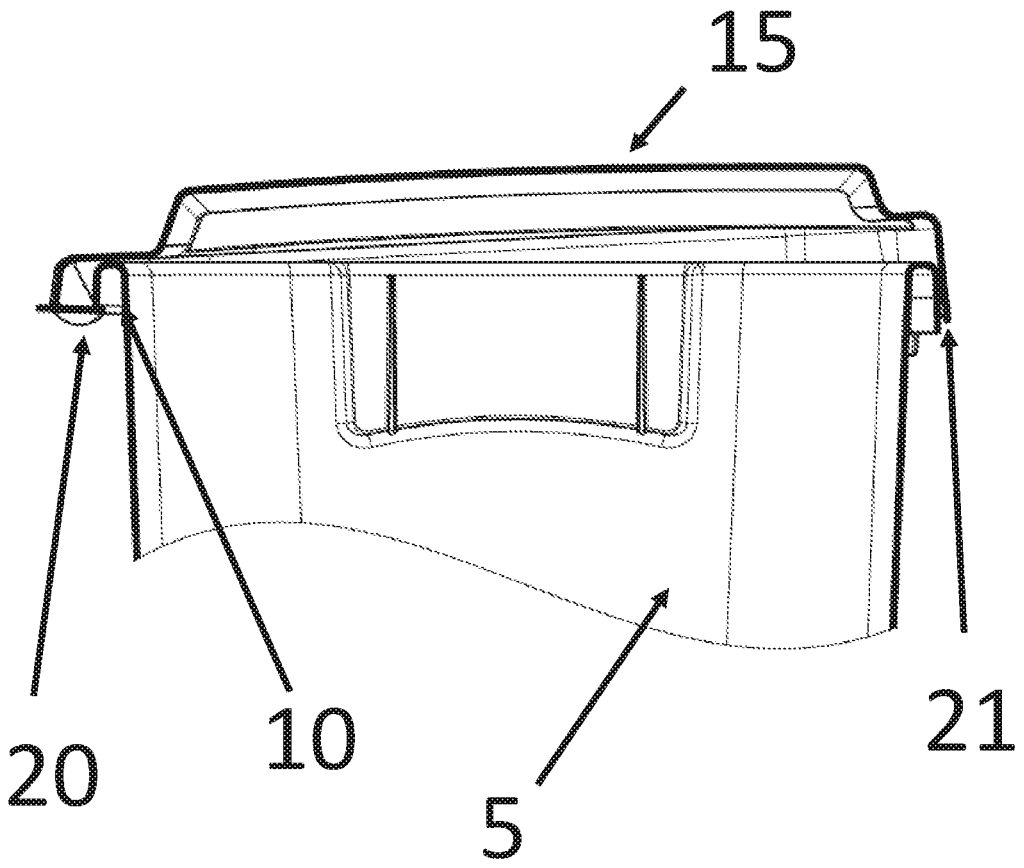
FIG. 9 is a cross sectional view through plane A-A of the trash receptacle of the instant invention with the lid closed.

FIG. 9 is a cross sectional view through plane A-A through the center of the trash receptacle of the instant invention with the lid closed. The rim-stop 21 is shown on the back of lid 15. The rim-stop 21 in the closed position is disengaged from the back 22 of trash receptacle 5.

Figure 10:
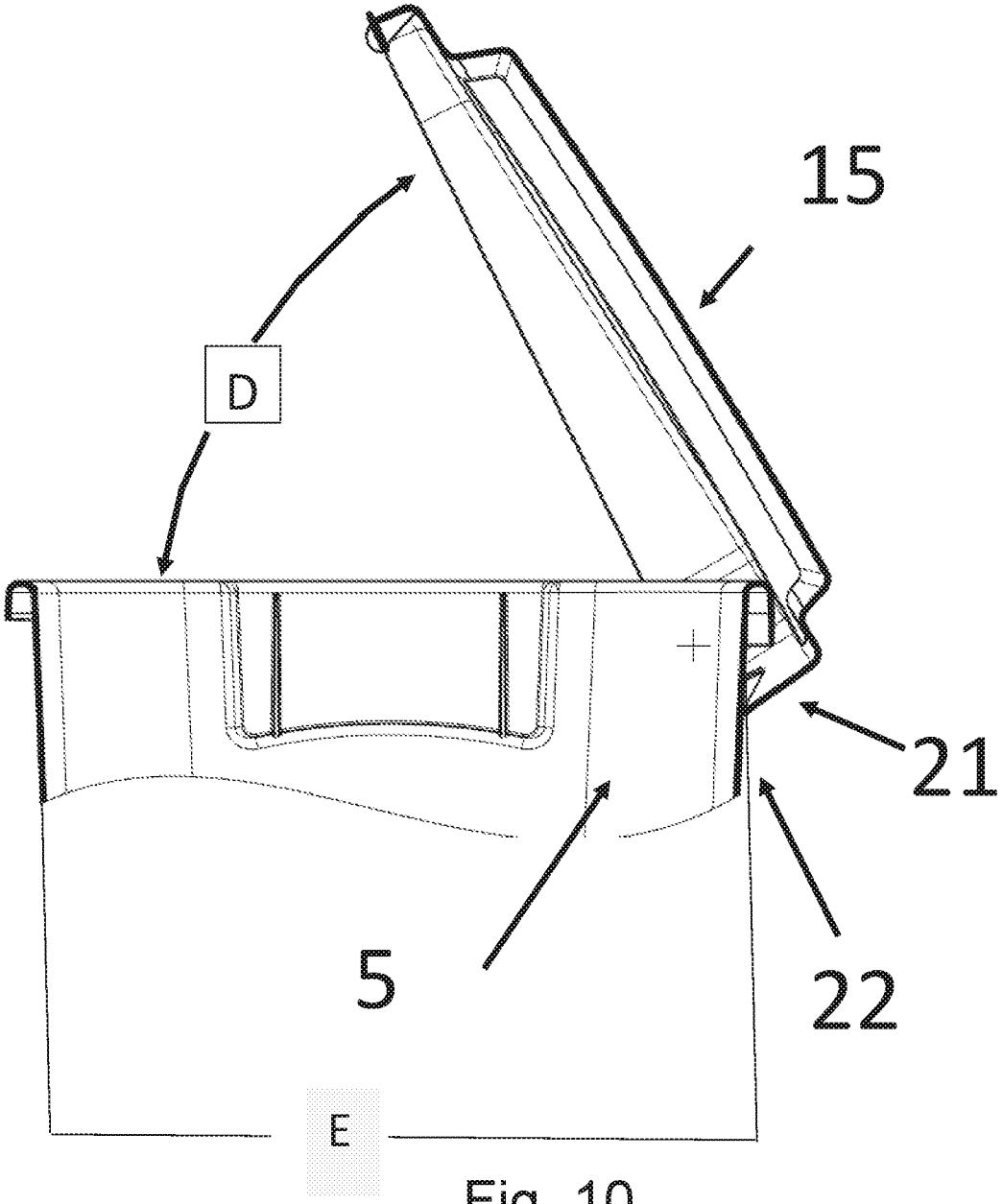
FIG. 10 shows a cross sectional view through plane A-A of the trash receptacle of the instant invention with the lid open.

FIG. 10 shows a cross sectional view through plane A-A of the trash receptacle of the instant invention with the lid open. The rim-stop 21 is shown on the back of lid 15. The rim-stop 21 in the open position is engaged with the back 22 of trash receptacle 5.

Figure 11:
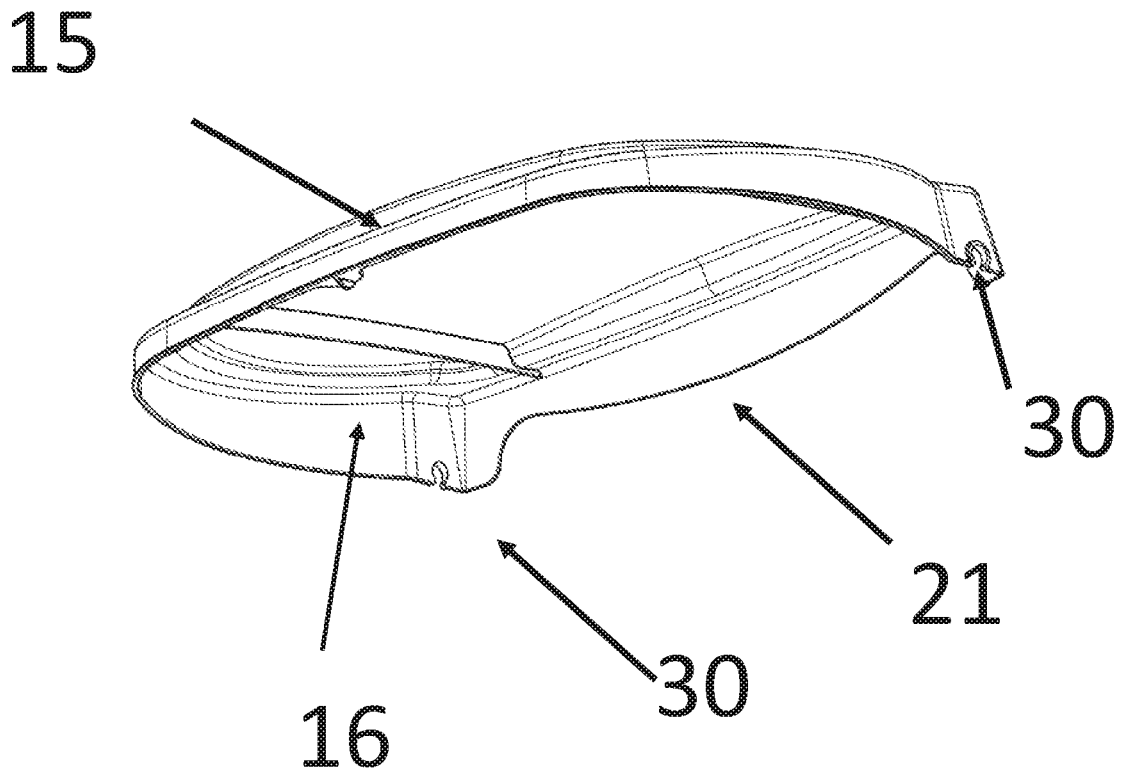
FIG. 11 shows a perspective view of a trash receptacle lid looking from the front.

FIG. 11 shows a perspective view of a trash receptacle lid looking from the front. The rim-stop 21 is shown on the back of lid 15.

Figure 12:
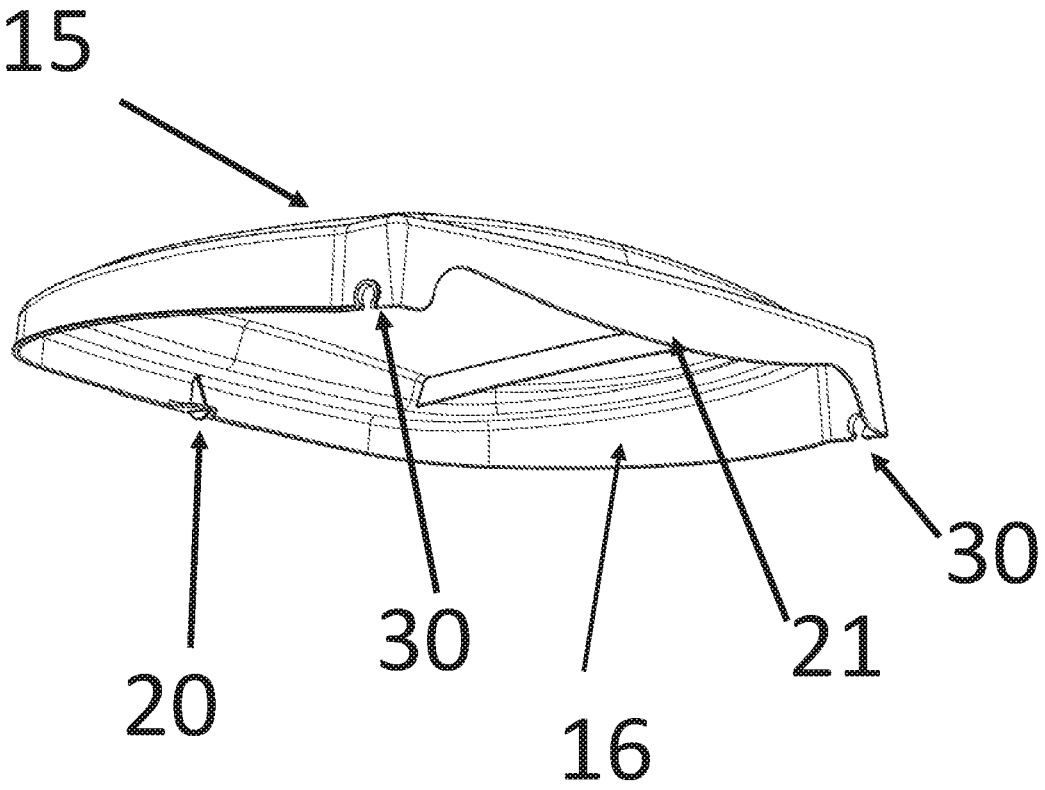
FIG. 12 shows a perspective view of a trash receptacle lid looking from the back.

FIG. 12 shows a perspective view of a trash receptacle lid looking from the back. The rim-stop 21 is shown on the back of lid 15.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains, and which fall within the limits of the appended claims.

What is claimed is:

1. A trash receptacle and lid assembly comprising:

a) a receptacle can comprising two sides, a front, a back and a bottom, a top opening and a top perimeter around the top opening forming a rim around said two sides, said front, said back and said bottom and said two sides, said front, said back and said bottom forming a hollow cavity and said receptacle can is made from a flame retardant plastic having flame-retardant rating of V-1 and said flame retardant plastic having fire retardant additives;

b) said two sides, said front, said back and said bottom having a first inner side and a second outer side and said two sides, said front, said back and said bottom being solid without holes;

b1) said receptacle lid assembly forming a receptacle lid that is rotatably removable from said receptacle can and said receptacle lid rests on said rim of the top opening of said receptacle can and said receptacle lid having two receptacle lid sides, a receptacle lid front, a receptacle lid back and said receptacle lid back having a receptacle lid back lid stop, a receptacle lid bottom, and a receptacle lid top and said receptacle lid is made from a flame retardant plastic having flame-retardant rating of V-1 and said receptacle lid being solid without holes;

c) said receptacle lid configured to rest on said rim of the top opening of said receptacle can and said receptacle lid further comprising said receptacle lid back lid stop that extends from said receptacle lid back, and a latch and said receptacle lid opening angle is approximately zero degrees when said receptacle lid is at rest on said rim;

d) a hinge configured between the top opening of said receptacle can and said receptacle lid and said receptacle lid capable of rotatably moving from a closed position to an open position;

e) said receptacle lid back lid stop engages with the back of said receptacle can when said receptacle lid is in said open position to prevent said receptacle lid from fully rotating around said hinge which forms an opening angle of up to 89 degrees between said perimeter of the opening of the receptacle can and said receptacle lid;

f) a center of gravity of said receptacle lid located over said top opening, when said opening angle of said receptacle lid is formed between said perimeter of said opening of the receptacle can and said receptacle lid;

g) said receptacle lid will fall to said closed position at said receptacle lid opening angle of zero degrees over said top opening when not held in said open position; and h) said receptacle lid back lid stop having one or more extensions, integrally molded to said receptacle lid, with said receptacle lid back lid stop extending downwards engaging said back side of said receptacle can.

2. The trash receptacle and lid assembly of claim 1 wherein the maximum opening angle of said receptacle lid is in the range of 50 degrees to 89 degrees.

3. The trash receptacle and lid assembly of claim 1, wherein said receptacle lid back lid stop extends from back side of said receptacle lid proximal to padeyes and engages with a back surface of said receptacle can when said receptacle lid is open to said opening angle.

4. The trash receptacle and lid assembly of claim 3, wherein more than one receptacle lid back lid stop extends from a back side of said receptacle lid.

5. The trash receptacle and lid assembly of claim 3, wherein said receptacle lid back lid stop has a curved extended edge.

6. The trash receptacle and lid assembly of claim 5, wherein said curved extended edge has a maximum extension centered on the back side of said receptacle lid.

7. The trash receptacle and lid assembly of claim 1, wherein the hinge comprises a first padeye and second padeye on said receptacle lid and a first pin and second pin on said receptacle can and said first padeye and said first pin are engageably positioned on the first side of said receptacle can and said second padeye and said second pin are engageably positioned on the second side of said receptacle can.

8. The trash receptacle and lid assembly of claim 1, wherein the opening angle is no more than 75 degrees.

9. The trash receptacle and lid assembly of claim 1, wherein the receptacle can comprises two solid sides, a solid front and a solid back and a solid bottom.

10. The trash receptacle and lid assembly of claim 1, wherein said flame retardant plastic having fire retardant additives are selected from the group consisting of boron compounds, antimony oxides, huntite, hydromagnesite, zinc oxides, organohalogen compounds, halogenated compounds, phosphate-ester compounds and antimony trioxide.

11. The trash receptacle and lid assembly of claim 1, wherein said flame retardant plastic having fire retardant additives are selected from the group consisting of combinations of boron compounds, antimony oxides, huntite, hydromagnesite, zinc oxides, organohalogen compounds, halogenated compounds, phosphate-ester compounds and antimony trioxide.

* * * * *